US007306698B2

(12) United States Patent
Akhtar et al.

(10) Patent No.: US 7,306,698 B2
(45) Date of Patent: Dec. 11, 2007

(54) METHOD FOR PRODUCING PULP

(75) Inventors: Masood Akhtar, Madison, WI (US); Ross E. Swaney, Madison, WI (US); Eric G. Horn, Madison, WI (US); Michael J. Lentz, Madison, WI (US); Gary M. Scott, Syracuse, NY (US); Cory C. Black, Gurnee, IL (US); Carl J Houtman, Madison, WI (US); T. K. Kirk, Verona, WI (US)

(73) Assignees: Biopulping International, Madison, WI (US); Wisconsin Alumni Research Foundation, Madison, WI (US)

( * ) Notice: Subject to any disclaimer, the term of this patent is extended or adjusted under 35 U.S.C. 154(b) by 22 days.

(21) Appl. No.: 10/100,469

(22) Filed: Mar. 18, 2002

(65) Prior Publication Data

US 2003/0041985 A1 Mar. 6, 2003

Related U.S. Application Data

(60) Provisional application No. 60/277,404, filed on Mar. 20, 2001.

(51) Int. Cl.
*D21C 3/04* (2006.01)
*D21C 3/12* (2006.01)
*D21C 3/20* (2006.01)

(52) U.S. Cl. ..... 162/76; 162/25; 162/68; 162/82

(58) Field of Classification Search ..... 162/5, 162/76, 82, 83, 68, 25, 28
See application file for complete search history.

(56) References Cited

U.S. PATENT DOCUMENTS

| | | | | |
|---|---|---|---|---|
| 1,396,227 | A * | 11/1921 | Marr | 162/5 |
| 3,556,110 | A | 1/1971 | Briskin et al. | |
| 3,580,311 | A | 5/1971 | Fox | |
| 3,586,537 | A * | 6/1971 | Steiner et al. | 127/37 |
| 3,793,279 | A | 2/1974 | Lipowski | |
| 3,861,402 | A | 1/1975 | Briskin | |
| 4,106,979 | A | 8/1978 | Ruffini et al. | |
| 4,260,452 | A | 4/1981 | Kruger et al. | |
| 4,283,252 | A | 8/1981 | Reinhall | |
| 4,511,433 | A | 4/1985 | Tournier et al. | |
| 4,515,657 | A * | 5/1985 | Maslanka | 162/164.3 |
| 4,594,130 | A | 6/1986 | Chang et al. | |
| 4,599,138 | A * | 7/1986 | Lindahl | 162/19 |
| 4,851,082 | A | 7/1989 | Mita et al. | |
| 5,221,357 | A | 6/1993 | Brink | |
| 5,306,392 | A | 4/1994 | Mita | |
| 5,338,402 | A | 8/1994 | Devic et al. | |
| 5,460,697 | A | 10/1995 | Akhtar et al. | |
| 5,562,803 | A * | 10/1996 | Wang et al. | 162/5 |
| 5,593,544 | A * | 1/1997 | Fahlgren et al. | 162/65 |
| 5,853,534 | A | 12/1998 | Hoglund et al. | |
| 6,475,338 | B1 * | 11/2002 | Jiang et al. | 162/19 |

FOREIGN PATENT DOCUMENTS

| | | |
|---|---|---|
| CA | 1274680 | 10/1990 |
| CN | 1072746 | 6/1993 |
| DE | 2041566 | 2/1972 |
| GB | 1156365 | 6/1969 |
| GB | 1 534 344 | 12/1978 |
| GB | 2036826 | 7/1980 |
| JP | 103002/78 | 9/1978 |
| JP | 55607/79 | 5/1979 |
| JP | 85497/81 | 7/1981 |
| JP | 57047604 A | 3/1982 |
| JP | 58084708 A | 5/1983 |
| JP | 63264991 | 11/1988 |
| JP | 10331084 A | 12/1998 |
| SU | 1420092 | 8/1988 |
| SU | 1567702 A | 5/1990 |

OTHER PUBLICATIONS

Abstract of CEH report on Oxalic Acid, http://www.sriconsulting.com/CEH/Public/Reports/682.1000/Abstract.html.*

* cited by examiner

*Primary Examiner*—Eric Hug
(74) *Attorney, Agent, or Firm*—Quarles & Brady LLP

(57) ABSTRACT

The present invention is a method for producing pulp from fibrous lignocellulose material using a treatment step which exposes the material to oxalic acid, or oxalic acid and sodium bisulfite, prior to pulping. The pulping of the resulting product requires less energy input and provides a pulp having enhanced physical properties as compared to untreated materials.

26 Claims, No Drawings

METHOD FOR PRODUCING PULP

CROSS-REFERENCE TO RELATED APPLICATIONS

This application claims the benefit under 35 U.S.C. 119(e) of U.S. Provisional Application No. 60/277,404, filed Mar. 20, 2001.

BACKGROUND OF THE INVENTION

In manufacturing paper from wood, the wood is first reduced to an intermediate stage in which the fibers in the wood are separated from their natural environment and transformed into a viscous liquid suspension called pulp. Of the various components of wood, the cellulose polymers are the most abundant and are the predominant molecules desired in the final pulp product. The second most abundant polymer, and least desirable pulp component, is lignin. Lignin is undesired because substantial amounts of lignin in pulp can deteriorate the smoothness of the final paper product and cause the paper to discolor when exposed to light. Lignin can also cause the pulp fibers to be rigid and weak.

Pulp may be produced from various types of woods using any one of several pulping techniques. The simplest of these techniques is the refiner mechanical pulping (RMP) method in which a mechanical milling operation grinds or abrades the wood in water until a desired state of freeness is achieved between its fibers. The RMP method is very efficient, typically converting approximately 95% of the dry weight of the wood into pulp. The RMP method, however, also leaves substantially all of the lignin in the pulp. As a result, RMP pulps generally provide low strength paper products having an opaque color. These paper products are generally used to manufacture newsprint or other low quality paper products.

Other pulping methodologies include thermo-mechanical pulping (TMP), chemical treatment with thermo-mechanical pulping (CTMP), chemi-mechanical pulping (CMP), and the chemical pulping, sulfate (kraft) or sulfite processes. In the chemical based methods, a chemical/water solution is generally used to dissolve the lignin and promote the separation of the fibers. The absence of lignin, in turn, makes the final paper products stronger and less prone to discoloration. These products often include paper bags, shipping containers, printing and writing papers, and other products requiring strength.

In thermo-mechanical processes (e.g., TMP and CTMP), high temperatures are used to separate the fibers during refining. These processes generally require the refining to be carried out in one or more steps. The first step is usually a pressurized step with refining being performed at temperatures above 100° C. and immediately below or at the softening temperature of lignin. During this step, the pulp is typically mechanically processed using the RMP method. In subsequent steps, the pressure and temperature is usually modulated to achieve the desired state of freeness between the fibers.

Relatively high total electric energy amounts or high quantities of input wood are required to produce pulps using the above mentioned pulping techniques. In particular, high energy inputs are generally required to obtain fiber separation in woods rich in lignin as such woods typically call for extended refining periods and high temperatures and/or pressures. Recent studies have also suggested that even thermal or chemical softening treatments of such woods does not guarantee a lower total energy consumption. This is because unprocessed fibers which are only mildly separated by the thermal or chemical treatments are difficult to fibrillate during the refining mechanical process.

Fibrillation is necessary to increase the flexibility of the fibers and bring about the fine material characteristics of quality processed pulp. In fact, it has been suggested that a decrease in the energy consumption from an established level in various TMP and CTMP processes has been associated with the deterioration of certain pulp properties, including a reduction in the long fiber content of the pulp, a lower tear strength and tensile strength, and a higher shives content. (See U.S. Pat. No. 5,853,534, issued to Hoglund et al., Dec. 29, 1998). As a result, high energy consumption in TMP and CTMP processes has been generally necessary in today's pulping practices.

U.S. Pat. No. 5,853,534 describes a method for producing pulp which attempts to overcome the above described energy consumption problem by performing mechanical or chemi-mechanical pulp in at least two steps. In the disclosed process, wood material is fed into a first refining step where it is mechanically processed at a temperature less than the softening temperature of lignin, and then fed into a second refining step where it is mechanically processed at a temperature exceeding the softening temperature of lignin. This process purports to guide fractures and fracture indications into the wood's fiber walls not rich in lignin during the first step to allow the fiber material to be separated with low energy inputs in areas rich in lignin during the second step. The process also purports to release fine material from areas between the initial fracture zone and the middle lamina of the fiber material rich in lignin during temperatures above the softening temperature of lignin, thus also lowering the total energy consumption in the process.

What is needed is an alternative method for producing pulp in an energy efficient manner which also improves paper strength properties while decreasing pollution.

BRIEF SUMMARY OF THE INVENTION

The present invention is a novel method for producing a pulp from a fibrous lignocellulose material using a pretreatment step which exposes the material to oxalic acid, or oxalic acid in combination with sodium bisulfite. Once treated, the material may be refined using any one of several pulping methods to produce a final pulp product.

In one embodiment, the method includes cooking the fibrous lignocellulose material at a temperature of between about 90° C. and 140° C. in a solution comprising oxalic acid prior to refining the material into a pulp. The dry weight amount of oxalic acid employed may be less than about 6%, or preferably less than about 5%, or more preferably between about 0.5% and 5%, or most preferably between about 1% and 3%, of the dry weight of the fibrous lignocellulose material. The treatment may be conducted at ambient pressures or higher, and for a period of time sufficient to allow the treated product to be later refined at reduced energy input levels as compared to untreated materials, typically less than about 4 hours. Once treated, the treated material may then be refined to form a pulp used to produced a final paper product.

In a second embodiment, the method includes mixing the fibrous lignocellulose material with oxalic acid dihydrate crystals; pressurizing the mixture with steam of about 30 p.s.i.g. or less, or more preferably about 25 p.s.i.g.; defiberizing the material using a thermo-mechanical fiberizer; and refining the defiberized material to produce a pulp. The dry weight amount of oxalic acid employed may be less than about 6%, or preferably less than about 5%, or more preferably between about 0.5% and 5%, or most preferably between about 1% and 3%, of the dry weight of the fibrous lignocellulose material.

In yet another aspect of the invention, the method further comprises augmenting the oxalic acid solution, or oxalic acid dihydrate crystals, with sodium bisulfite to prevent the darkening of the material as it is processed. The dry weight amount of sodium bisulfite employed may be about 8% or less, or preferably between about 4% to 8%, more preferably between about 5% to 7%, and most preferably about 6% of the dry weight of the fibrous lignocellulose material.

One object of the present invention is to provide a method for producing pulp that is more energy efficient and less costly than standard pulping methods.

Another object of the present invention is to provide a method for producing pulp that has improved physical properties over pulps prepared using other conventional techniques.

It is one advantage of the present invention that paper produced from pulp manufactured in accordance with the disclosed method is stronger than other pulping methods, and results in a paper with a tear index of approximately 3.0 or more.

It is another advantage of the present invention that the combination of oxalic acid and sodium bisulfite provides a pulp with improved strength and minimal to no brightness penalty.

It is yet another advantage of the present inventions that the cooking liquor resulting from the present invention may be recycled and used in subsequent pretreatment processes.

Other features, advantages and objects will become apparent upon review of the specification, claims and drawing.

BRIEF DESCRIPTION OF THE SEVERAL VIEWS OF THE DRAWINGS

None.

DETAILED DESCRIPTION OF THE INVENTION

The present invention is a method for producing pulp from fibrous lignocellulose materials using a pretreatment step which exposes the material to oxalic acid, or oxalic acid and sodium bisulfite. In general, the pretreatment step includes heat treating the fibrous lignocellulose material (e.g., wood) in combination with oxalic acid, or oxalic acid and sodium bisulfite. Once treated, the material may be refined using any one of several pulping methods to produce a final pulp product.

The use of oxalic acid, or oxalic acid and sodium bisulfite, as described below, results in a pulp with improved physical properties which, in turn, provides enhanced physical properties in the final paper product. For example, the use of oxalic acid as a pretreatment to the pulp refining process results in a pulp that produces a paper product with improved strength properties. The use of oxalic acid and sodium bisulfite, on the other hand, results in a pulp that produces paper having improved strength with minimal to no brightness penalty.

The use of oxalic acid, or oxalic acid and sodium bisulfite, as described below, also provides an economic benefit to the pulping process. In particular, the use of either solution provides electrical energy savings when compared to conventional pulping processes. Their use may also result in material savings as the resulting pretreatment cooking liquors may be recovered and reused in subsequent applications. Although a detailed economic analysis has not yet been performed, it is estimated that $7 million to $8 million dollars per year in energy costs and kraft pulp costs could be saved in a 200 ton per day operation operating 350 days per year.

Fibrous lignocellulose materials treated in accordance with the present invention are defined to generally include materials containing both cellulose polymers and lignin. These materials typically include matter capable of being processed into pulp for making paper products. Such materials may include, for example, hardwoods (i.e., broadleafed species) and softwoods (i.e., conifers). More specifically, these materials may include the Southern Yellow Pines, Spruces, Western Hemlock, Aspens, and other smaller diameter trees. The material may also originate from either round wood (e.g., whole trees), residue (e.g., wood scraps left behind from forest and sawmill operations), or recovered paper. Recovered paper may include both pre-consumer recovered paper, such as trimmings and scraps from printing, carton manufacturing, or other converting processes which are reused to make pulp without reaching the final consumer, or post-consumer paper, such as corrugated boxes, newspapers, magazines, and office paper which has been recycled.

In general, prior to beginning the pretreatment process, the fibrous lignocellulose material is first reduced to a size appropriate for pulping, as is well known in the art. This will ensure that the material is sufficiently treated with the oxalic acid or with the oxalic acid and sodium bisulfite. In the preferred embodiment, the material to be treated is reduced to wood chips. It is anticipated, however, that the present method may also be effective with materials not reduced to wood chips, such as those materials derived from recovered paper or wood residues. It is also anticipated that the present method may also be effective in treating pulp.

In one embodiment, the fibrous lignocellulose material is heat treated in a solution having an amount of oxalic acid effective in improving the physical properties of the pulp and/or reducing energy input levels under the conditions described below. The amount of oxalic acid employed, as expressed in dry weight percentage, may be less than about 6%, or preferably less than about 5%, or more preferably between about 0.5% and 5%, or most preferably between about 1% and 3%, of the dry weight of the fibrous lignocellulose material.

Alternatively, the fibrous lignocellulose material may be mixed with oxalic acid dihydrate crystals, and subjected to thermo-mechanical processing. The amount of oxalic acid dihydrate crystals employed, as expressed in dry weight percentage, may be less than about 6%, or preferably less than about 5%, or more preferably between about 0.5% and 5%, or most preferably between about 1% and 3%, of the dry weight of the fibrous lignocellulose material.

The fibrous lignocellulose material may also be heat treated with oxalic acid, as described above, in combination with sodium bisulfite. The amount of sodium bisulfite employed, expressed in dry weight percentage, may be about 8% or less, or preferably between about 4% and 8%, or more preferably between about 5% and 7%, and most preferably about 6%, of the dry weight of the fibrous lignocellulose material.

The combined fibrous lignocellulose material and oxalic acid, or oxalic acid and sodium bisulfite, will generally be heat treated at ambient pressure or higher for a time sufficient to allow the treated product to be refined at reduced energy input levels, as compared to untreated materials, or refined to produce a pulp that provides a paper with improved strength, as compared to untreated materials. The temperature, time and pressure may vary from application to application as the machinery employed may differ in its functional characteristics, or because a skilled artisan may desire to obtain specific paper properties or processing parameters. A skilled artisan would be able to readily determine the optimal time, temperature and pressure for each particular application to arrive at the artisan's desired outcome.

The fibrous lignocellulose material and oxalic acid solution may, for example, be heat treated at a temperature of between about 90° C. and 140° C., or preferably at a temperature of between about 90° C. and 130° C., or most preferably at a temperature of between about 100° C. or about 130° C. The cooking time may be between about 1 minute and about 4 hours, and more preferable between about 10 minutes and about 3 hours, but will depend primarily on the concentration of the oxalic acid in the solution, the temperature of the heat treatment and the pressure in the cooking chamber. The temperature range and the time period of the heat treatment may also vary depending upon the size of the fibrous lignocellulose material, the type of fibrous lignocellulose material being treated, and the physical properties desired in the final pulp product.

The fibrous lignocellulose material and oxalic acid dihydrate crystals may, for example, be treated using a thermo-mechanical process. Under this method the material and oxalic acid dihydrate crystals would be subjected to a pressurized steam of about 30 p.s.i.g. or less, or more preferably about 25 p.s.i.g., while being sent through a thermo-mechanical refiner for fiberization.

After heat treating, the treated fibrous lignocellulose material is then washed and prepared for pulping. Many pulping methods are suitable for the present invention although mechanical pulping is preferred.

In its simplest form, a mechanical refining process is utilized. Dilution water is added to the treated material and the material is run through a mechanical refiner in a number of sequential passes. The number of passes of the treated material/pulp mixture will depend upon the freeness desired for the particular paper application to be made. Freeness is an arbitrary measure of water drainage. The treated material/pulp mixture is repeatedly fed through refiners until the desired level of freeness is achieved. Thus freeness may be periodically monitored to determine the progress of the pulps toward the freeness level which is desired for the paper. The pulp may also be dewatered as necessary between passes. Loblolly pine, treated using the procedures described above, requires between about 2 to 6 repeated passes to obtain a 100 ml CSF value in a single rotating 300 mm diameter disk atmospheric refiner.

The overall energy efficiency of the process can be compared with that of a standard process by pulping untreated material in the same apparatus while at the same time monitoring the energy consumption of the refining mill itself. As shown in the Examples below, the treated material requires significantly less energy input through the refiner to achieve the same level of freeness in the resulting pulps.

The pulps made through this procedure may then be made into paper using standard papermaking techniques. Standard techniques (as described by the Technical Assocation of the Pulp and Paper Industry, TAPPI) known to work with refined pulps work equally well with pulps of the type created by the process described herein.

Paper made from the pulp prepared according to the present invention (treated pulp) can be compared in quality, strength and texture to that created using untreated material and standard pulping methods. Here, the treated pulp exhibits significantly increased strength property, thus indicating that the process of the present invention does not sacrifice the quality or strength of the paper in order to achieve the highly desirable energy savings. In fact, the present invention provides a unique combination of significant reduction in energy use with an increase in the strength properties of the resulting paper.

The details of the process of the present invention will become more apparent from the following Examples which describe the laboratory-scale utilization of the present process and the results achieved thereby. It is understood that the scale-up from a laboratory-scale to a plant-scale process of the pulping operation described below may involve some alteration of the parameters or details of the process steps described herein. It is to be understood that the Examples described below, while they demonstrate the efficacy and practicability of the process of the present invention, have not been optimized for a commercial scale.

Nevertheless, the experimental evidence presented makes it clear that the procedure is efficacious and efficient and enables the creation of commercial scale-procedures for implementing the general process described herein.

EXAMPLES

Example 1

Union Camp pine logs were obtained from Louisiana, chipped and then treated with a solution of oxalic acid in accordance with the present invention. Once treated, the chips were refined into a pulp, and the pulp used to prepare handsheets for testing.

Wood Preparation

Logs were debarked and chipped at U.S.D.A. Forest Products Laboratory (Madison, Wis.) to a nominal size of 6-14 mm. The chips were then placed in barrels and frozen to prevent the growth of contaminating microorganisms. The moisture content of the chips was measured to be approximately 48%.

Heat Treatment

Oxalic acid dihydrate from Sigma-Aldrich in a quantity of 69.04 grams per 1-kilogram was added with water to oven dried wood chips (5% oxalic acid to oven dried wood chips) at a liquor to wood ratio of about 4:1, respectively. A stationary digester was then used to cook several 1 kg samples of wood chips, oven dry basis, over varying temperatures and times, as is illustrated in Table 1. A Honeywell chart recorder was used to measure the cooking temperature. After cooking, the treated wood chips were washed thoroughly and frozen until refining.

Chip Fiberization, Pulp Refining and Handsheet Production

The treated wood chips were refined to a pulp and then used to produce paper. Treated wood chips were first fiberized in a Sprout-Waldron Model D2202 single rotating 300 mm diameter disk atmospheric refiner. The feed rate through the refiner provided a power consumption level of between 10 kW and 15 kW. The refiner plate settings were 0.025 inch, 0.014 inch, 0.010 inch, and 0.008 inch.

Pulp was collected at each pass as hot water slurry. Between the passes the pulp slurry was dewatered to approximately 25% solids in a porous bag by vacuum.

Dilution water at 85° C. was then added each time as the pulp was fed into the refiner. Samples of the pulp were taken and tested for the Canadian Standard Freeness (CSF) and the process continued until the samples were refined to 100 CSF.

Energy consumption was measured using an Ohio Semitronic Model WH 30-11195 integrating Wattmeter attached to the power supply side of the 44.8 kW electric motor. The energy data from this experiment is listed in Table 1 and reported as percent energy savings. Hand sheets were also prepared and tested using TAPPI standard testing methods. The results from this testing are also reported in Table 1.

TABLE 1

Union Camp Pine Treatments

| Sample Identitication (° C./min/% oxalic acid) | Burst (kN/g) | Tear (mN-m^2/g) | Energy Savings (%) |
|---|---|---|---|
| Control | 0.39 | 1.89 | — |
| 90/30/5 | 0.40 | 1.94 | 2 |
| 90/60/5 | 0.33 | 2.56 | 4 |
| 90/90/5 | 0.40 | 2.46 | 9 |
| 90/120/5 | 0.45 | 2.43 | 6 |
| 90/150/5 | 0.48 | 2.33 | 9 |
| 90/180/5 | 0.60 | 2.20 | 19 |
| 95/90/5 | 0.60 | 2.52 | 23 |
| 95/180/5 | 0.76 | 3.42 | 19 |
| 100/30/5 | 0.40 | 1.90 | 5 |
| 100/90/5 | 0.72 | 2.95 | 16 |
| 100/180/5 | 0.84 | 3.83 | 23 |
| 105/60/5 | NA | 2.36 | 11 |
| 105/90/5 | NA | 2.91 | 25 |
| 105/120/5 | NA | 3.30 | 25 |
| 105/180/5 | NA | 3.38 | 25 |
| 110/30/5 | 0.56 | 1.94 | 4 |
| 110/90/5 | NA | 3.07 | 28 |
| 110/120/5 | NA | 3.16 | 26 |
| 120/30/5 | 0.64 | 2.32 | 12 |
| 130/10/5 | 0.59 | 2.19 | 9 |
| 130/20/5 | 0.72 | 2.63 | 15 |
| 130/30/5 | 0.74 | 2.66 | 15 |
| 140/30/5 | 0.77 | 2.17 | 10 |

N/A = Not available.

Example 2

Aspen wood chips were obtained from Stora Enso North America (Biron, Wis.) (formely, Consolidated Papers, Inc.) and treated with a solution of oxalic acid according to the method described in Example 1. Varying times and temperatures were used as set forth in Table 2. Chips ranged from 6-10 mm. Moisture content was measured to be about 50%.

Once treated, the treated chips were refined to a pulp and then used to produce paper as described in Example 1. Energy consumption was measured as above and is reported in Table 2 as percent energy savings. Handsheets were also prepared and tested using TAPPI standard testing methods. The results from this testing are also reported in Table 2.

TABLE 2

Aspen Treatments

| Sample Identitication (° C./min/% oxalic acid) | Burst (kN/g) | Tear (mN-m^2/g) | Energy Savings (%) |
|---|---|---|---|
| Control | 0.68 | 2.08 | — |
| 90/60/5 | 0.67 | 2.13 | 11 |
| 90/90/5 | 0.67 | 2.08 | 17 |
| 95/60/5 | 0.65 | 2.07 | 19 |
| 100/60/5 | 0.66 | 2.22 | 39 |

Example 3

Union Camp pine logs were obtained from Louisiana, chipped and stored according to the method described in Example 1. The moisture content of the chips was measured to be approximately 48%.

The chips were treated with a solution of oxalic acid as described in Example 1 which was augmented with either 75 grams of sodium bisulfite ("BIS") (approximately 6% BIS to oven dried wood chips), or 10 grams of BIS (approximately 1% BIS to oven dried wood chips). Varying times and temperatures were used as illustrated in Table 3. Once treated, the treated chips were refined to a pulp and then used to produce paper as described above. Energy consumption was measured and is reported in Table 3 as percent energy savings. Handsheets were also prepared and tested using TAPPI standard testing methods. The results from this testing are also reported in Table 3.

TABLE 3

Union Camp Pine Treatments with Sodium Bisulfite and Oxalic Acid

| Sample Identitication (° C./min/% oxalic acid + BIS) | Burst (kN/g) | Tear (mN-m^2/g) | Energy Savings (%) | ISO Brightness (%) |
|---|---|---|---|---|
| Control | 0.47 | 2.05 | — | 50.5 |
| 100/180/5 | 0.84 | 3.83 | 30 | 44.8 |
| 100/180/5 + 75 g BIS[a] | 0.78 | 3.98 | 26 | 49.7 |
| 100/180/5 + 75 g BIS[b] | 0.75 | 3.14 | 20 | 44.1 |
| 100/180/5 + 10 g BIS[a] | 0.72 | 3.03 | 11 | 45.7 |
| 100/180/75 g. BIS | 0.71 | 2.18 | 11 | 51.0 |

[a]Oxalic acid and BIS mixed and cooked together
[b]BIS added after the cook

Example 4

Union Camp pine logs were obtained from Louisiana, chipped and stored according to the method described in Example 1. The moisture content of the chips was measured to be approximately 48%.

The chips were then mixed with oxalic acid dihydrate crystals at a dry weight of either 5% or 1% of the chip's dry weight, and heat treated with steam pressurized to 25 p.s.i.g. for 1 minute and 15 seconds. During this time, the chips were sent through a thermo-mechanical refiner (Sprout-Bauer, model #1210P, having a plate pattern D2B505, and 300-mm diameter) for fiberization.

The subsequent fiber stock was further developed using the atmospheric refiner mechanical pulping process as described in Example 1. Once refined, the prepared pulp was used to produce paper as previously described. Energy consumption was measured as above and reported in Table 4 as percent energy savings. Handsheets were also prepared and tested using TAPPI standard testing methods. The results from this testing are also reported in Table 4.

TABLE 4

Use of Oxalic Acid for Thermo-mechanical Pulping

| Sample Identification (% oxalic acid) | Burst (kN/g) | Tear (mN-m^2/g) | Energy Savings (%) |
|---|---|---|---|
| Control | 0.55 | 2.55 | — |
| 5% Oxalic Acid | 0.60 | 2.55 | 33 |
| 1% Oxalic Acid | 0.58 | 2.53 | 20 |

Example 5

Union Camp pine logs were obtained from Louisiana, chipped and stored according to the method described in Example 1. The moisture content of the chips was measured to be approximately 48%.

The chips were then treated with supplementary cooking acids, hydrochloric acid and sulfuric acid, to determine whether the cooking acids effectively promote electrical energy savings or improvements in paper strength when used under the treatment protocols of the present invention. Solutions of sulfuric acid ($H_2SO_4$) and hydrochloric acid (HCl), having concentrations equivalent to the pH of a standard solution of oxalic acid, were added to oven dried wood chips at a liquor to wood ratio of about 4:1, respectively. A stationary digester was used to cook several 1 kg samples of wood chips, oven dry basis, over varying temperatures and times.

After cooking, the treated chips were refined to a pulp and used to produce paper as described in Example 1. Energy consumption was measured as above and reported in Table 5 as percent energy savings. Hand sheets were also prepared and tested using TAPPI standard testing methods. The results from this testing are also reported in Table 5.

TABLE 5

Treatment with sulfuric or hydrochloric acid

| Sample Identification (acid) | Burst (kN/g) | Tear (mN-m^2/g) | Energy Savings (%) |
|---|---|---|---|
| Control | 0.68 | 2.08 | — |
| HCl | 0.54 | 2.61 | 12 |
| $H_2SO_4$ | 0.50 | 2.29 | 16 |

Example 6

Union Camp pine logs were obtained from Louisiana, chipped and stored according to the method described in Example 1. The moisture content of the chips was measured to be approximately 48%.

The chips were treated with oxalic acid of varying amounts (3%, 2%, 1%, and 0.5% per 1-kilogram of oven dried wood chips) according to the method described in Example 1. Varying times and temperatures were used as illustrated in Table 6. Once treated, the chips were refined to a pulp and used to produce paper as above. Energy consumption was measured as above and reported in Table 6 as percent energy savings. Handsheets were also prepared and tested using TAPPI standard testing methods. The results from this testing are also reported in Table 6.

TABLE 6

Union Camp Pine Treatments

| Sample Identitication (° C./min/% oxalic) | Burst (kN/g) | Tear (mN-m^2/g) | Energy Savings (%) |
|---|---|---|---|
| Control | 0.47 | 2.05 | — |
| 130/10/1 | 0.70 | 2.94 | 22 |
| 130/10/2 | 0.74 | 3.19 | 30 |
| 130/10/3 | 0.81 | 3.61 | 32 |
| 130/20/1 | 0.69 | 3.07 | 26 |
| 130/30/1 | 0.71 | 3.16 | 27 |
| 130/30/0.5 | 0.63 | 2.34 | 18 |
| 130/60/0.5 | 0.63 | 2.33 | 16 |
| 130/90/0.5 | 0.61 | 2.40 | 15 |

TABLE 6-continued

Union Camp Pine Treatments

| Sample Identitication (° C./min/% oxalic) | Burst (kN/g) | Tear (mN-m^2/g) | Energy Savings (%) |
|---|---|---|---|
| 140/10/1 | 0.83 | 3.44 | 32 |
| 140/10/2 | 0.89 | 3.91 | 24 |
| 140/10/3 | 0.93 | 4.12 | 30 |

Example 7

Union Camp pine logs were obtained from Louisiana, chipped and stored according to the method described in Example 1. The moisture content of the chips was measured to be approximately 48%.

The chips were then treated with oxalic acid of varying amounts (3%, 2%, and 1% per 1-kilogram of oven dried wood chips) according to the method described in Example 1. Varying times and temperatures were used as illustrated in Table 7. After cooking, the treated chips were washed thoroughly and frozen until refined in a thermo-mechanical pulping (TMP) process.

As part of the TMP process, the treated wood chips were pressurized with steam to 25 p.s.i.g. for 1 minute and 15 seconds. During this time the chips were sent through a thermo-mechanical refiner (Sprout-Bauer, model #1210P, plate pattern D2B505, 300 mm diameter) for fiberization at a plate gap setting of 0.029 inch.

The subsequent fiber stock was further developed through an atmospheric refiner mechanical pulping (RMP) process and then used to produce paper. The RMP process was performed using a Sprout-Waldron Model D2202 single rotating 300 mm diameter disk atmospheric refiner. The fiber stock was fed through the refiner at a rate such that a power consumption level of between 10 kW and 15 kW was produced. The refiner plate settings were 0.025 inch, 0.014 inch, 0.010 inch, and 0.008 inch.

Pulp was collected at each pass as hot water slurry. Between passes the pulp slurry was dewatered to approximately 25% solids in a porous bag by vacuum. Dilution water at 85° C. was added each time as the pulp was fed into the refiner. Samples of the pulp were then taken and tested for their CSF value and the process continued until the samples were refined to 100 CSF.

Energy consumption was measured using an Ohio Semitronic Model WH 30-11195 integrating Wattmeter attached to the power supply side of the 44.8 kW electric motor. The energy data from this experiment is listed in Table 7 and reported in percent energy savings. Handsheets were also prepared and tested using TAPPI standard testing methods. The handsheets were also analyzed for their brightness as compared to handsheets prepared using pulp produced through a conventional RMP process and a conventional TMP process. The results from this testing are also reported in Table 7.

TABLE 7

Union Camp Pine Treatments

| Sample Identitication (° C./min/% oxalic acid) | Burst (kN/g) | Tear (mN-m^2/g) | Energy Savings (%) | ISO Brightness (%) |
|---|---|---|---|---|
| Control | 0.62 | 2.42 | — | 51.1 |
| 130/10/1 | 0.74 | 3.15 | 26 | 47.5 |

TABLE 7-continued

Union Camp Pine Treatments

| Sample Identitication (° C./min/% oxalic acid) | Burst (kN/g) | Tear (mN-m^2/g) | Energy Savings (%) | ISO Brightness (%) |
|---|---|---|---|---|
| 130/10/2 | 0.78 | 3.24 | 32 | 46.2 |
| 130/10/3 | 0.88 | 3.97 | 36 | 45.3 |

These results were further compared to the loss in brightness experienced by paper produced using pulp that was subject to a fungal pretreatment process. Normally, fungal pretreatment and/or chemical modification processes result in the darkening of the pulp and a reduced brightness in the final paper product. Here, oxalic acid treated chips fiberized by TMP darkened less than the same wood chips fiberized by RMP (Table 8), and significantly less than chips subjected a fungal pretreatment and fiberized by TMP or RMP. (Table 9).

TABLE 8

Oxalic Acid Treated Union Camp Pine Paper Brightness

| Refining Type | Control (%) | Treatment (%) | Difference (%) |
|---|---|---|---|
| RMP (Refiner Mechanical Pulping) | 50.5 | 46.7 | 4.4 |
| TMP (Thermomechanical Pulping) | 51.1 | 47.5 | 3.6 |

TABLE 9

Fungal Pretreated Union Camp Pine Paper Brightness

| Refining Type | Control (%) | Treatment (%) | Difference (%) |
|---|---|---|---|
| RMP (Refiner Mechanical Pulping) | 50.5 | 40.0 | 10.5 |
| TMP (Thermomechanical Pulping) | 51.1 | 35.8 | 15.3 |

Example 8

Wood chips were treated in accordance to the method of the present invention and the cooking liquor recycled to determine whether or not it could be recovered and reused.

Union Camp pine logs were obtained from Louisiana, chipped and stored according to the method described in Example 1. The moisture content of the chips was measured to be approximately 48%.

The chips were cooked at 130° C. for 10 minutes in 41.42 grams of oxalic acid per 1-kilogram oven dried wood chips (approximately 3% oxalic acid to oven dried wood chips) according to the method described in Example 1. After cooking, wood chips were washed thoroughly and frozen until refining. The cooking liquor was collected after each cook and reused following an augmentation with approximately 20.71 grams (50%) of the initial oxalic acid.

Once treated, the chips were refined to a pulp and used to produce paper as described in Example 1. Energy consumption was measured as described and is reported in Table 10 as percent energy savings. Handsheets were also prepared and tested using TAPPI standard testing methods. The results from this testing are also reported in Table 10, wherein Recycle 4 and Recycle 5 indicate recycled cooking liquor augmented and used for the fourth and fifth time, respectively.

TABLE 10

Union Camp Pine Treatments

| Sample Identitication (° C./min/% oxalic) acid) | Burst (kN/g) | Tear (mN-m^2/g) | Energy Savings (%) |
|---|---|---|---|
| Control | 0.62 | 2.42 | — |
| 130/10/3 | 0.79 | 3.57 | 27 |
| 130/10/3 Recycle 4 | 0.79 | 3.52 | 25 |
| 130/10/3 Recycle 5 | 0.81 | 3.42 | 24 |

Example 9

Wood were heat treated at 130° C. for 10 minutes of oxalic acid approximate to 1.5% oxalic acid (dry weight) to oven dried wood chips, in order to determine if the treatment provided equivalent electrical energy savings and improved paper strength as compared to wood chips treated using recycled cooking liquor, as described in Example 8, and to determine the optimal amount of oxalic acid needed to maintain electrical energy savings and improved paper strength using recycled cooking liquor.

Union Camp pine logs were obtained from Louisiana, chipped and stored according to the method described in Example 1. The moisture content of the chips was measured to be approximately 48%.

The chips were cooked at 130° C. for 10 minutes in 20.71 grams of oxalic acid per 1-kilogram oven dried wood chips (approximately 1.5% oxalic acid to oven dried wood chips) according to the method described in Example 1. Once treated, the chips were refined to a pulp and used to produce paper as described in Example 1. Energy consumption was measured as described and is reported in Table 11 as percent energy savings. Handsheets were also prepared and tested using TAPPI standard testing methods. The results from this testing are also reported in Table 11.

TABLE 11

Union Camp Pine Treatments

| Sample Identification (° C./min/% oxalic acid) | Burst (kN/g) | Tear (mN-m^2/g) | Energy Savings (%) |
|---|---|---|---|
| Control | 0.62 | 2.42 | — |
| 130/10/1.5 | 0.72 | 3.11 | 26 |

Comparing these results with the data illustrated in Table 10 above indicates that improvements in paper strength are obtained using a recycled cooking liquor which has been augmented to percent ratio of 3% oxalic acid to oven dried wood chips, as compared to wood chips heat treated in fresh oxalic acid at about 1.5%.

We claim:

1. A method for pulping a fibrous lignocellulose material, the method comprising the steps of:

(a) reducing the material to a size appropriate for pulping;

(b) cooking the reduced material with oxalic acid at an amount between 0.05% and about 6% of the dry weight of the reduced material, wherein the material is cooked at a temperature between greater than 100° C. and about 140° C. for a time between greater than 10 minutes and about 180 minutes, these conditions being sufficient for cooking the reduced material in such a manner so as to enable step (c);

(c) mechanically defiberizing the cooked material; and (d) mechanically refining the defiberized material to produce a pulp that exhibits improved paper strength and energy savings relative to uncooked pulp, wherein the material is wood or a recovered paper capable of being processed into pulp for making paper products.

2. The method of claim 1 wherein the oxalic acid is at an amount between about 0.5% and about 5% of the dry weight of the reduced material.

3. The method of claim 1 wherein the oxalic acid is at an amount between about 1% and about 3% of the dry weight of the reduced material.

4. The method of claim 1 wherein the cooked material is refined using either a mechanical pulping method or a thermo-mechanical pulping method.

5. The method of claim 1 wherein the material is cooked at a temperature of between greater than 100° C. and about 130° C.

6. A method for pulping a fibrous lignocellulose material, the method comprising the steps of:

(a) reducing the material to a size appropriate for pulping;

(b) cooking the reduced material with oxalic acid at an amount between 0.05% and about 6% of the dry weight of the reduced material, wherein the material is cooked at a temperature between greater than 100° C. and about 140° C. for a time between greater than 10 minutes and about 180 minutes. these conditions being sufficient for cooking the reduced material in such a manner so as to enable step (d):

(c) further cooking the reduced material with sodium bisulfite at an amount between greater than about 1% and about 8% of the dry weight of the reduced material; and (d) mechanically refining the cooked material into a pulp, such that the pulp product exhibits improved paper strength and energy savings relative to uncooked pulp, wherein the material is wood.

7. The method of claim 6 wherein the sodium bisulfite is at an amount between about 4% and about 8% of the dry weight of the reduced material.

8. The method of claim 6 wherein the sodium bisulfite is at an amount between about 5% and about 7% of the dry weight of the reduced material.

9. The method of claim 6 wherein the sodium bisulfite is at an amount of about 6% of the dry weight of the reduced material.

10. A method for producing pulp from a fibrous lignocellulose material, the method comprising the steps of:

(a) reducing the material to a size appropriate for pulping;

(b) mixing the reduced material with oxalic acid dihydrate at an amount between 0.05% and about 6% of the dry weight of the reduced material;

(c) cooking the mixture in the presence of pressurized steam, wherein the pressure is less than about 30 p.s.i.g, the conditions of steps (b) and (c) being sufficient to enable defiberization of the cooked material;

(d) defiberizing the cooked material using a thermo-mechanical fiberizer; and (e) mechanically refining the defiberized material to produce a pulp that exhibits improved paper strength and energy savings relative to uncooked pulp, wherein the material is wood or a recovered paper capable of being processed into pulp for making paper products.

11. The method of claim 10 wherein the oxalic acid dihydrate is at an amount between about 0.5% and about 5% of the dry weight of the reduced material.

12. The method of claim 10 wherein the oxalic acid dihydrate is at an amount between about 1% and about 3% of the dry weight of the reduced material.

13. The method of claim 10 wherein the reduced material is further mixed with sodium bisulfite at an amount between greater than about 1% and about 8% of the dry weight of the reduced material.

14. The method of claim 13 wherein the sodium bisulfite is at an amount between about 4% and about 8% of the dry weight of the reduced material.

15. The method of claim 13 wherein the sodium bisulfite is at an amount between about 5% and about 7% of the dry weight of the reduced material.

16. The method of claim 13 wherein the sodium bisulfite is at an amount of about 6% of the dry weight of the reduced material.

17. The method of claim 10 wherein the mixture is steam heated at a pressure of about 25 p.s.i.g.

18. The method of claim 10 wherein the defiberized material is refined using either a mechanical pulping method or a thermo-mechanical pulping method.

19. A method for pulping wood material, the method comprising the steps of:

(a) reducing the material to a size appropriate for pulping;

(b) cooking the reduced material with oxalie acid at an amount between about 0.05% and about 6% of the dry weight of the reduced material, wherein the material is cooked at a temperature between greater than 100° C. and about 140° C. for a time between greater than 3 minutes and about 180 minutes, these conditions being sufficient for cooking the reduced material in such a manner so as to enable step (c); and (c) mechanically defiberizing the cooked material; and (d) mechanically refining the defiberized material to produce a pulp that exhibits improved paper strength and enemy savings relative to uncooked pulp, wherein the material is hardwood or softwood.

20. The method of claim 19 wherein the material originates from either round wood or wood residue.

21. The method of claim 19 wherein the wood is selected from the group consisting of Southern Yellow Pine, Spruce, Western Hemlock and Aspen.

22. A method for pulping recovered paper material, the method comprising the steps of:

(a) reducing the material to a size appropriate for pulping;

(b) cooking the reduced material with oxalic acid at an amount between about 0.05% and about 6% of the dry weight of the reduced material, wherein the material is cooked at a temperature between greater than 100° C. and about 140° C. for a time between greater than 3 minutes and about 180 minutes, these conditions being sufficient for cooking the reduced material in such a manner so as to enable step (c); and (c) mechanically refining the cooked material into a pulp, such that the pulp product exhibits improved paper strength and energy savings relative to uncooked pulp, wherein the material includes pre-consumer recovered paper selected from the group consisting of trimmings and scraps from printing, carton manufacturing, and other converting processes which are reused to make pulp without reaching the final consumers; or post-consumer paper selected from the group consisting of corrugated boxes, newspapers, magazines, and office paper which has been recycled.

23. A method for producing pulp from wood material, the method comprising the steps of:

(a) reducing the material to a size appropriate for pulping;

(b) mixing the reduced material with oxalic acid dihydrate at an amount between about 0.05% and about 6% of the dry weight of the reduced material;

(c) cooking the mixture with steam at a pressure of less than about 30 p.s.i.g, the conditions of steps (b) and (c) being sufficient to enable defiberization of the cooked material;

(d) defiberizing the cooked material using a thermo-mechanical fiberizer; and (e) mechanically refining the defiberized material to produce a pulp that exhibits improved paper strength and energy savings relative to uncooked pulp, wherein the material is hardwood or softwood capable of being processed into pulp for making paper products.

24. The method of claim 23 wherein the material is selected from either round wood comprising whole trees or wood residue comprising wood scraps left behind from forest and sawmill operations.

25. The method of claim 23 wherein the wood is selected from the group consisting of Southern Yellow Pine, Spruce, Western Hemlock, and Aspen.

26. A method for producing pulp from recovered paper material, the method comprising the steps of:

(a) reducing the material to a size appropriate for pulping;

(b) mixing the reduced material with oxalic acid dihydrate at an amount between about 0.05% and about 6% of the dry weight of the reduced material;

(c) cooking the mixture with steam at a pressure of less than about 30 p.s.i.g, the conditions of steps (b) and (c) being sufficient to enable defiberization of the cooked material;

(d) defiberizing the cooked material using a thermo-mechanical fiberizer; and (e) mechanically refining the defiberized material to produce a pulp that exhibits improved paper strength and energy savings relative to uncooked pulp, wherein the material includes pre-consumer recovered paper selected from the group consisting of trimmings and scraps from printing, carton manufacturing, and other converting processes which are reused to make pulp without reaching the final consumer; or post-consumer paper selected from the group consisting of corrugated boxes, newspapers, magazines, and office paper which has been recycled.

* * * * *

UNITED STATES PATENT AND TRADEMARK OFFICE

CERTIFICATE OF CORRECTION

PATENT NO. : 7,306,698 B2
APPLICATION NO. : 10/100469
DATED : December 11, 2007
INVENTOR(S) : Masood Akhtar et al.

It is certified that error appears in the above-identified patent and that said Letters Patent is hereby corrected as shown below:

On the title page, item [73] add third Assignee --The United States of America as Represented by the Secretary of Agriculture, Washington, District of Columbia 20250--.

Signed and Sealed this

Second Day of December, 2008

JON W. DUDAS
*Director of the United States Patent and Trademark Office*